United States Patent [19]

Perlich et al.

[11] 4,006,912

[45] Feb. 8, 1977

[54] SKI PROTECTOR

[75] Inventors: Frank J. Perlich, Excelsior, Minn.; Frank J. Perlich, Jr., Big Sky, Mont.; Jon R. Perlich, Tucson, Ariz.; Timothy C. McLaughlin, Mound, Minn.

[73] Assignee: Frank J. Perlich, Excelsior, Minn.

[22] Filed: Sept. 24, 1975

[21] Appl. No.: 616,259

[52] U.S. Cl. ..... 280/11.38; 150/52 R

[51] Int. Cl.[2] ..... A63C 11/20

[58] Field of Search ..... 280/11.38, 11.37 E, 280/11.37 R, 11.37 K, 11.13 T, 11.13 R, 11.13 L, 11.13 M, 11.13 G, 601, 610, 603, 28; 224/5 Z, 45 S; 150/52 R, .5; 280/28

[56] References Cited

UNITED STATES PATENTS

| | | | |
|---|---|---|---|
| 1,925,697 | 9/1933 | Johnson | 280/11.38 |
| 2,150,988 | 3/1939 | Russell | 280/11.38 X |
| 2,180,686 | 11/1939 | Lorinovich | 280/11.37 K |
| 2,699,809 | 1/1955 | Nebe et al. | 150/52 L |
| 3,120,963 | 2/1964 | Seckel | 280/28 |
| 3,886,987 | 3/1975 | Schuchman | 150/52 R |

FOREIGN PATENTS OR APPLICATIONS

| | | | |
|---|---|---|---|
| 261,329 | 5/1965 | Australia | 150/52 G |
| 95,128 | 3/1939 | Sweden | 280/11.13 R |
| 536,193 | 5/1941 | United Kingdom | 280/11.38 |

*Primary Examiner*—Joseph F. Peters, Jr.
*Assistant Examiner*—Milton L. Smith
*Attorney, Agent, or Firm*—Stuart R. Peterson

[57] ABSTRACT

A ski protector of elastomeric material comprises an elongated resilient or elastic body portion and reinforced end portions having recesses, one of which recesses accommodates the toe of the ski therein and the other recess the ski's heel. The stretching capability of the unreinforced elongated body portion permits the end of the protector that fits over the ski's toe to first be placed thereover, then the other end of the protector pulled rearwardly sufficiently past the rear end of the ski and then released so that it moves forwardly over the ski's heel. The sides of the elongated body contain grooves for receiving therein the side margins of the ski to thus protect the ski's metal edges. The body portion is preferably provided with a web extending between the grooved sides, thereby affording protection for the bottom running surface of the ski as well.

14 Claims, 8 Drawing Figures

SKI PROTECTOR

BACKGROUND OF THE INVENTION

1. Field of the Invention

This invention relates generally to a ski accessory, and pertains more particularly to a resilient protector that can be easily fitted over the ends and sides of the ski.

2. Description of the Prior Art

The need for maintaining the metal edges of skis in a sharpened condition and devoid of nicks is generally well known, especially by skiers who participate in racing where the competition can be extremely keen. The racer recognizes that he needs every advantage he can get and endeavors to maintain his skis in tip top shape. Where skis can be transported or shiped so they do not rub against each other or against other objects, such as on a car top ski rack, the problem of preserving the edges and running surface is not severe.

However, where skis are stowed with other skis in, say, the trunk of an automobile or on a bus, care must be exercised to prevent one ski from rubbing against another, or even worse against some other object. If padding is placed between the various skis, then the likelihood of damage can be reduced or even eliminated. There is always the uncertainty, though, that the padding will shift or become dislodged.

Where the skis must be shipped by air, as frequently happens where the skier's destination is miles away or even in a foreign country, the skier loses all control of the manner in which his skis are handled in transit. Plastic bags or flexible cases are on the market, and they afford some protection, but not sufficiently so as to assure that the skis will never be damaged. Also, the bags or cases just alluded to are designed to hold a pair of skis and the two skis are apt to rub against each other during shipment. Airlines have recognized that a problem exists and have attempted to solve the problem by providing elongated cardboard boxes or tubes. However, the jostling of a pair of skis against each other still does not preclude dulling of their edges.

SUMMARY OF THE INVENTION

Accordingly, a general object of the present invention is to provide a ski protector that will assure the skier that his skis will always remain in excellent condition. In this regard, it is an aim of the invention to protect both the metal edges and the running surface of the ski.

Another object of the invention is to provide a resilient or elastic ski protector that can be easily put on and taken off the ski it is intended to safeguard.

Another object is to provide a protector of the foregoing type that will not inadvertently come off the ski.

Also, another object is to provide a protector that can be used without interference with the ski's bindings.

A further object of the invention is to provide a resilient ski protector that can be manufactured in a single size, a size that will fit most skis even though the skis may vary appreciably in length.

Still further, an object of the invention is to provide a separate ski protector for each ski so that a pair of skis can be carried or strapped together depending upon the particular circumstances. Where skis are to be placed in a confined space, such as in the trunk of an automobile, it is frequently more convenient, if not mandatory, to place one ski in the trunk first and then the second. Where a number of pairs of skis are to be transported this way, it becomes even more important to be able to maneuver each ski individually in order to utilize efficiently whatever space exists, the present invention enabling this to be done.

Yet another object of the invention is to provide a protector that will be of lightweight construction, so that it will not noticeably add to the weight of the ski. This is of particular advantage when the skis are carried by a skier when walking.

Further, an object of the invention is to provide a ski protector that will be inexpensive to manufacture, yet extremely durable and longlasting, thereby encouraging its widespread use by all types of skiers irrespective of whether they are racers.

Also, the invention has for an object the provision of a ski protector that will be attractive as well as useful.

Briefly, our invention contemplates a one-piece ski protector of a material such that it can be stretched sufficiently so as to enable the skier to fit one end thereof over the toe of his ski and the other end over its heel, the resiliency permitting him to do this. The inherent elasticity of the protector assures that the protector will remain on the ski and not inadvertently become dislodged. Inasmuch as the sides of the ski are received in grooves extending longitudinally along the body of the protector, the ski's metal edges are safeguarded and by means of a connecting web extending between the sides of the protector the bottom running surface of the ski is likewise protected. A suitable elastomer is intended to impart sufficient elasticity to the protector, although the recessed end portions thereof are intended to be reinforced, it being planned that an appropriate fabric, such as woven polyester fibers, be employed.

DESCRIPTION OF THE PREFERRED EMBODIMENT

Figures 1, 2, 3, 4, 5, 6, 7, 8:
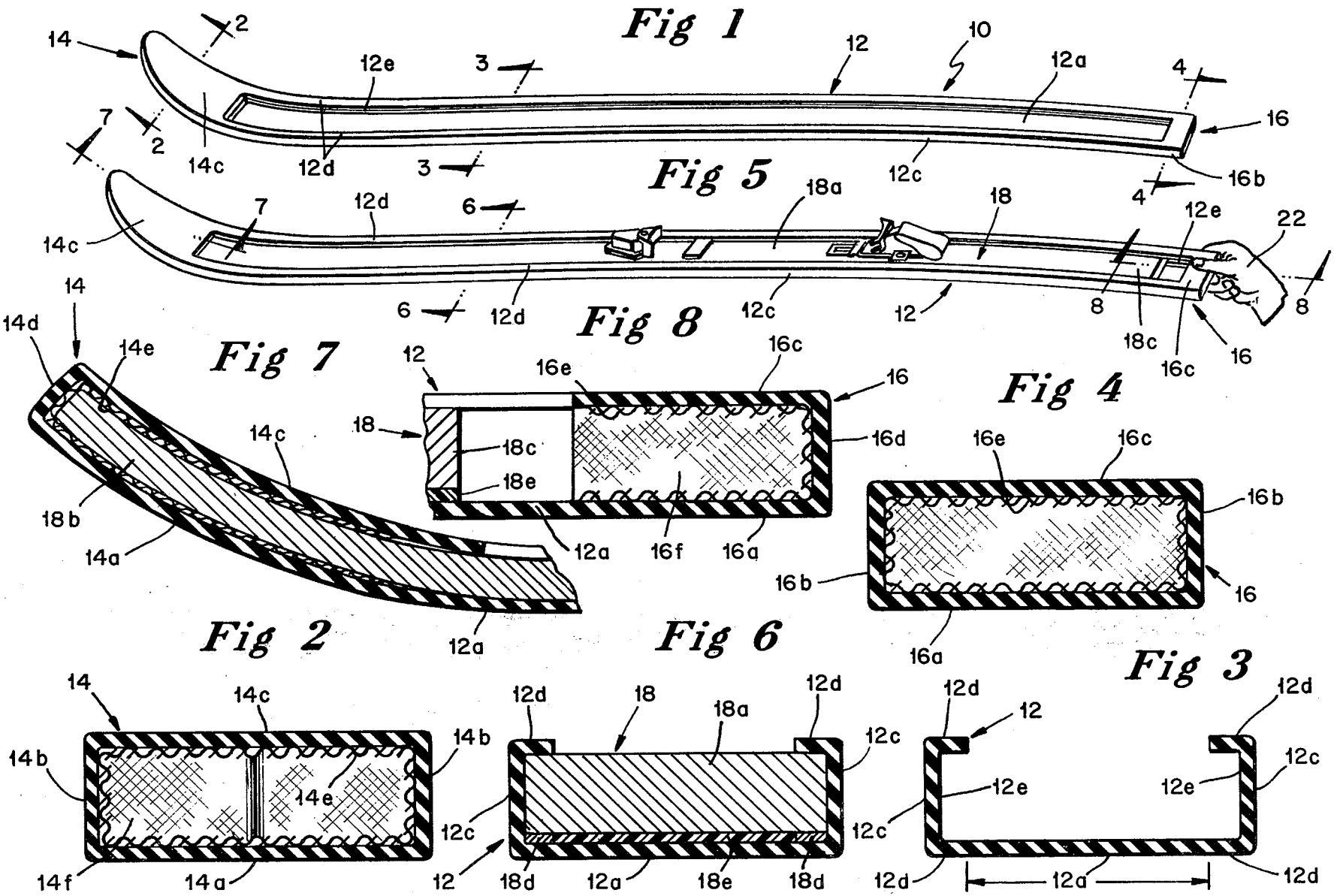
FIG. 1 is a perspective view of a protector exemplifying our invention.
FIG. 2 is a transverse sectional view taken in the direction of line 2—2 of FIG. 1 for the purpose of illustrating the construction of the toe portion of our protector.
FIG. 3 is a transverse sectional view taken in the direction of line 3—3 of FIG. 1, the view showing the cross sectional configuration of the elongated body.
FIG. 4 is a transverse sectional view taken in the direction of line 4—4 of FIG. 1, this view depicting the construction of the heel portion of our protector.
FIG. 5 is a perspective view corresponding generally to FIG. 1 but illustrating the manner in which the protector is fitted over the heel of the ski.
FIG. 6 is a transverse sectional view taken in the direction of line 6—6 of FIG. 5, the view showing the manner in which the elongated body of our protector safeguards the metal edges and running surface of the ski.
FIG. 7 is a longitudinal view tken in the direction of line 7—7 of FIG. 5, this view showing how the toe of the ski fits within the forward portion of our protector.
FIG. 8 is a longitudinal view taken in the direction of line 8—8 of FIG. 5 showing to better advantage how the rear end of our protector is fitted over the ski's heel.

Although our protector is preferably fabricated from rubber, either natural or synthetic, it can be stated at the outset that various elastomeric materials can be used. More specifically, certain plastic resins can be made sufficiently elastic so as to fulfill the desired end sought when practicing our invention. Also, a combination of rubber and appropriate plastic materials can be resorted to. An elastomer is usually defined as a material which at room temperature can be stretched repeatedly to at least twice its original length and, upon immediate release of the stress, will return with force to its approximate original length. The word has also been defined more broadly as a rubber-like natural or synthetic product which when physically stretched returns to its original shape and strength. While the first definition will certainly embrace any material that would be excellent when used in fabricating our ski protector, it will be recognized that the second definition also is applicable as long as the material possesses the capability of being stretched or elongated enough to permit it to be placed on a ski. However, the more resilient or elastic the material, the more ski sizes a single protector will fit. As the description progresses, it is believed that it will become apparent that a number of suitable materials can be utilized when practicing the teachings of our invention.

Referring now to the drawing, our ski protector has been denoted generally by the reference numeral 10 in FIG. 1. It is comprised of three basic portions. The central or body portion has been labeled 12, whereas the forward end portion has been assigned the reference numeral 14 and the rear end portion the reference numeral 16.

The body portion 12, as best understood from FIG. 3, comprises a bottom web 12*a* that connects with U-shaped side sections composed of a leg 12*b* that forms a lateral continuation of the web 12*a*, an upwardly directed bight section 12*c* at each side and inwardly turned upper leg sections 12*d*. Thus, the sections 12*b*, 12*c* and 12*d* form the U-shaped configuration just alluded to and thereby provide a longitudinal groove 12*e* at each side of the body portion 12. Although the parts 12*a*–12*d* have been individually referred to, it will be appreciated that the body portion 12 can be molded or extruded in one piece.

As far as the forward or toe portion 14 is concerned, it is composed of a bottom wall 14*a* which is a forward continuation of the web 12*a* (best understood from FIG. 7). Additionally, the portion 14 includes sidewalls 14*b* (best understood from FIG. 2) and a top wall 14*c* (FIGS. 2 and 7). The tip of the toe portion 14 is closed and has been given the reference numeral 14*d* (FIG. 7). Inasmuch as it is planned that the protector 10 be fabricated from an appropriate elastomeric material having the desired degree of resiliency or stretchability, it becomes desirable to line the interior of the toe portion 14 with a reinforcing fabric; this fabric, which is appropriately bonded to the elastomeric material, has been labeled 14*e* and is preferably composed of woven polyester fibers. The cavity formed by the walls 14*a*, 14*b*, 14*c* and tip 14*d*, as lined by the fabric 14*e*, result in the formation of a recess 14*f*. The toe portion 14 is molded so as to have an upwardly curving configuration, as is believed evident from FIGS. 1, 5 and 7.

Turning now to a description of the heel portion 16, it will be discerned that it comprises a bottom wall 16*a*, side walls 16*b*, a top wall 16*c* and a rear wall 16*d*. The bottom wall 16*a* is a rearward continuation of the bottom web 12*a* (best seen in FIG. 8). As with the toe portion 14, it is desirable to line the interior of the heel portion 16 with an appropriate reinforcing fabric; this fabric has been given the reference numeral 16*e* and as with the fabric 14*e* is bonded to the surface of the elastomeric material. A recess 16*f* is thus formed within the heel portion 16.

Although the manner of using our ski protector 10 should be readily apparent from the foregoing, it perhaps will be of benefit to show a ski 18 having the usual body 18*a*, a toe 18*b* (FIG. 7) at the forward end, a heel 18*c* (FIG. 8) at the rear, metal edges 18*d* and a layer of plastic, usually high density polyethylene, forming a bottom running surface 18*e* (FIG. 6). For the sake of completeness, a two-part binding is shown in FIG. 5. Attention is called to the fact that our protector 10 can be placed on the ski without interference as far as the usual binding is concerned.

Although the manner of using our ski protector 10 should be readily apparent from the foregoing information that has been presented, it might be well to explain briefly how one puts the protector 10 on the ski 18. First, the forward end portion 14 is slipped over the toe 18*b* of the ski. Then, the user pulls the rear portion 16 rearwardly, a hand 22 being depicted at the right of FIG. 5 to show how this action is performed. When the rear end portion 16 is pulled sufficiently rearwardly, the body portion 12 yielding to permit this, the release of the portion 16 will permit it to automatically move or contract forwardly over the heel 18*c*, owing to the elasticity of the material constituting the body portion 12. If the side margins of the ski 18 do not automatically go into the grooves 12*e* at each side of the body portion, then the skier simply works forward from the heel portion 16, flexing the inturned legs 12*d* sufficiently so as to accommodate and receive the side margins of the ski. When this is done, then the ski 18 is completely protected (see FIG. 6) as far as its edges 18*d* and running surface 18*e* are concerned.

When the protector 10 is to be removed, then the skier again retracts the end portion 16. After retracting the end portion, he can flex the body portion 12 through an angle with respect to the bottom running surface 18*e* of the ski 18, then literally peeling the body portion 12 forwardly until the side margins of the ski are completely free of the grooves 12*e*. He then slips off the forward portion 14 from the toe 18*b* of the ski 18.

It will be recognized that basically the material selected for our ski protector 10 need only elongate sufficiently to permit the heel portion 16 to be placed over the heel 18*c* of the ski 18. However, the more elastic or resilient the material is, the more readily a single size protector can be used for skis of different lengths. Thus, while a true elastomer is the preferred material, it should now be clear that modified materials will suffice. Also, it should be taken into account that the material should have an adequate hardness, it being within the purview of the invention to utilize a rubber or plastic material that has a durometer scale of from 30 to 95. By utilizing a material having this degree of hardness, then the edges 18*d* will be better protected from even the severest of blows or knocks against various objects that might be encountered when transporting skis. It will also be appreciated that conventional molding, extruding, heat sealing, vulcanizing, glueing techniques, or a combination thereof, are available in the making of our protector 10, the particular technique (or techniques) depending mainly on the type of material selected.

We claim:

1. A ski protector comprising an elongated body portion having inwardly facing U-shaped grooves at the sides thereof for receiving therein only the marginal sides of a ski and having a height corresponding substantially to the thicknes of said sides, a first portion at one end of said elongated body portion having top, bottom and side walls forming a recess or cavity for enclosing the toe of the ski, and a second portion at the other end of said elongated body portion having top, bottom and side walls forming a recess or cavity for enclosing the heel of the ski, said body portion and the grooves therein extending from said first portion to said second portion and at least a longitudinal section of said body portion being resilient so that, when said first portion is placed over the ski's toe, said second portion can be pulled rearwardly and then released to fit over the heel.

2. A ski protector in accordance with claim 1 in which said first end portion curves upwardly from said body portion and said second end portion extends axially from said body portion.

3. A ski protector in accordance with claim 2 in which said body and end portions are all of a resilient material.

4. A ski protector in accordance with claim 3 in which said body and end portions are all the same resilient material.

5. A ski protector in accordance with claim 4 in which said end portions contain fabric a reinforcing material.

6. A ski protector in accordance with claim 5 in which said resilient material is an elastomer.

7. A ski protector in accordance with claim 6 in which said elastomer is rubber.

8. A ski protector in accordance with claim 7 in which said reinforcing material extends over substantially the entire inner surface of said end portions and is bonded to said rubber forming said end portions.

9. A ski protector in accordance with claim 8 in which said fabric is woven with polyester fibers.

10. A ski protector in accordance with claim 1 in which each U-shaped groove provides upper and lower leg sections and an interconnecting bight section at each side of said body portion, said upper leg sections confronting the upper surface of the ski's side margins and the lower leg sections confronting the metal edges of said ski, said bight sections confronting the sides of the ski.

11. A ski protector in accordance with claim 10 including means interconnecting said lower leg surfaces so as to confront the bottom running surface of the ski.

12. A ski protector in accordance with claim 11 in which said interconnecting means constitutes a web integral with said lower leg sections so as to cover the ski's bottom running surface.

13. A ski protector in accordance with claim 12 in which said body portion is of resilient material throughout its length.

14. A ski protector in accordance with claim 12 in which said body and end portions are of resilient material and said end portions have a reinforcing fabric bonded to the inner surfaces thereof.

* * * * *